United States Patent [19]

Stevens

[11] 4,439,878

[45] Apr. 3, 1984

[54] SOFA SLEEPER WITH SEAT ADJUSTMENT MECHANISM

[75] Inventor: John E. Stevens, Carthage, Mo.

[73] Assignee: Leggett & Platt, Incorporated, Carthage, Mo.

[21] Appl. No.: 370,976

[22] Filed: Apr. 22, 1982

[51] Int. Cl.[3] ..... A17C 17/04

[52] U.S. Cl. ..... 5/29; 5/13; 297/313

[58] Field of Search ..... 5/13 R, 13 A, 28, 29, 5/31–34, 51 G, 51 L

[56] References Cited

U.S. PATENT DOCUMENTS

| | | | |
|---|---|---|---|
| 993,656 | 5/1911 | Deimel | 5/31 |
| 1,249,270 | 12/1917 | Beach | 5/51 G |
| 2,445,241 | 7/1948 | Pokorny et al. | 5/13 A |
| 2,748,398 | 6/1956 | Thomas | 5/13 |
| 2,803,018 | 8/1957 | Piliero | 5/13 |
| 3,516,096 | 6/1970 | Mikos | 5/13 |
| 3,694,828 | 10/1972 | Mikos et al. | 5/13 |
| 4,301,559 | 11/1981 | Geenberghe | 5/29 |

FOREIGN PATENT DOCUMENTS

| | | | |
|---|---|---|---|
| 395485 | 7/1933 | United Kingdom | 5/13 A |

*Primary Examiner*—Alexander Grosz
*Assistant Examiner*—Michael F. Trettel
*Attorney, Agent, or Firm*—Wood, Herron & Evans

[57] ABSTRACT

A sofa sleeper having a foldable bed frame connected by a collapsible frame support linkage with a sofa frame. The collapsible frame support linkage includes a novel styling structure that permits the pitch of the seat, when the bed frame is in the sofa position, to be adjusted as desired. This styling structure, in preferred form, includes a styling link incorporated in the collapsible frame support linkage that cooperates with a vertically adjustable styling bolt mounted on the sofa frame. The abutment position of the styling link against the styling bolt, which position depends on the vertical location of the styling bolt relative to ground, determines the collapsed position of the collapsible frame support linkage, thereby establishing the seat pitch of the sofa.

8 Claims, 5 Drawing Figures

SOFA SLEEPER WITH SEAT ADJUSTMENT MECHANISM

This invention relates to sofa sleepers. More particularly, this invention relates to a sofa of the type having a foldable bed frame that is retractable interiorly of the sofa's frame when the unit is to be used as a sofa, and which is extendable into a platform configuration when the unit is to be used as a bed.

Sofa sleepers are well known to the prior art. A sofa sleeper basically includes a sofa frame and a foldable bed frame that supports a mattress. The sofa sleeper is adapted for use as a sofa when the bed frame is retracted into a storage attitude within the sofa frame to permit use of the structure as a seating surface. The sofa sleeper also can be used as a bed when the bed frame is extended from the storage attitude into a generally horizontal bed attitude to permit use of the structure as a sleeping surface. Prior art sofa sleepers are illustrated in U.S. Pat. Nos. 3,854,153; 4,173,803; and 4,253,205, all assigned to the assignee of this application.

In the manufacture of sofa sleepers, one common method of doing business is for a first manufacturer to supply the bed frame linkage system by which the bed frame is extended into the bed attitude and collapsed into the sofa attitude, and for a second manufacturer to install the bed frame linkage system in a sofa frame. In other words, the sofa manufacturer does not fabricate the bed frame linkage system. It is commonly the case, therefore, that the sofa manufacturer, who is skilled in the art of constructing sofas, merely purchases the bed frame linkage system from a supplier, and then installs the bed frame linkage system in the sofa manufacturer's own sofa frame. And the sofa manufacturer will have a series of different styled sofa sleepers that make up a sofa sleeper line. In other words, the sofa manufacturer will produce a number of sofa sleeper styles, but it is desirable that all of those sofa sleeper styles make use of a common bed frame linkage system in the various sofa styles.

When a sofa manufacturer carries a series of sofa sleeper end products, i.e., a line of sofa sleepers, there are certain characteristics that distinguish one sofa sleeper style from another. A first styling difference between sofa sleepers is that the pitch of the seating surface, when the bed frame is retracted into sofa configuration, may vary from one sofa sleeper style to another in the manufacturer's sofa sleeper line. In other words, the angle of the sofa sleeper's seating surface in the sofa position, relative to horizontal, may vary from one sofa sleeper to another. A second styling difference between sofa sleepers is the height of the sleeper's front rail relative to ground. Some sofa sleepers having a higher or lower profile front rail than others, the actual height of the front rail from ground being primarily an aesthetic design characteristic of the sofa sleeper. The front rail profile height is dependant on the front edge height for the seat surface when the bed frame is in the sofa position. As noted, it is desirable to the sofa sleeper manufacturer that the bed frame linkage system purchased from the manufacturer of that system can be adapted to provide for either of these styling details in the various sofa sleeper styles offered by the sofa sleeper manufacturer.

Accordingly, it has been the primary objective of this invention to provide an improved collapsible bed frame support linkage for a sofa sleeper that includes a seat adjustment mechanism which permits the pitch of the seat surface to be varied as desired when the bed frame support linkage is in the sofa position, and/or which permits the top front edge height of the bed frame to be varied relative to ground as desired when the bed frame support linkage is in the sofa position.

It has been another objective of this invention to provide an improved sofa sleeper having a foldable bed frame that is connected to a sofa frame by a collapsible frame support linkage, the collapsible frame support linkage including a styling link that cooperates with an adjustable styling stop, the stop being positionable in that final position which provides a desired pitch for the seat surface when the bed frame is in the sofa position, and/or which provides a desired front edge height for the seat surface when the bed frame is in the sofa position.

In accord with these objectives, the improved sofa sleeper of this invention includes an extendable bed frame connected by a collapsible frame support linkage with a sofa frame. The collapsible frame support linkage includes a novel styling structure that permits the pitch of the seat, when the bed frame is in the sofa position, to be adjusted as desired. This styling structure, in preferred form, includes a styling link incorporated in the collapsible frame support linkage that cooperates with a vertically adjustable styling bolt mounted on the sofa frame. The abutment position of the styling link against the styling bolt, which position depends on the vertical location of the styling bolt relative to ground, determines the collapsed position of the collapsible frame support linkage, thereby establishing the seat pitch of the sofa.

Other objectives and advantages of the invention will be more apparent from the following detailed description taken in conjunction with the drawings in which:

FIG. 1 is a side elevational view illustrating an improved sofa sleeper in accord with the principles of this invention, the sofa sleeper's bed frame being shown in the fully extended or bed position;

FIG. 1*a* is an enlarged view of the encircled area 1*a* of FIG. 1;

Figures 1, 1A, 4:
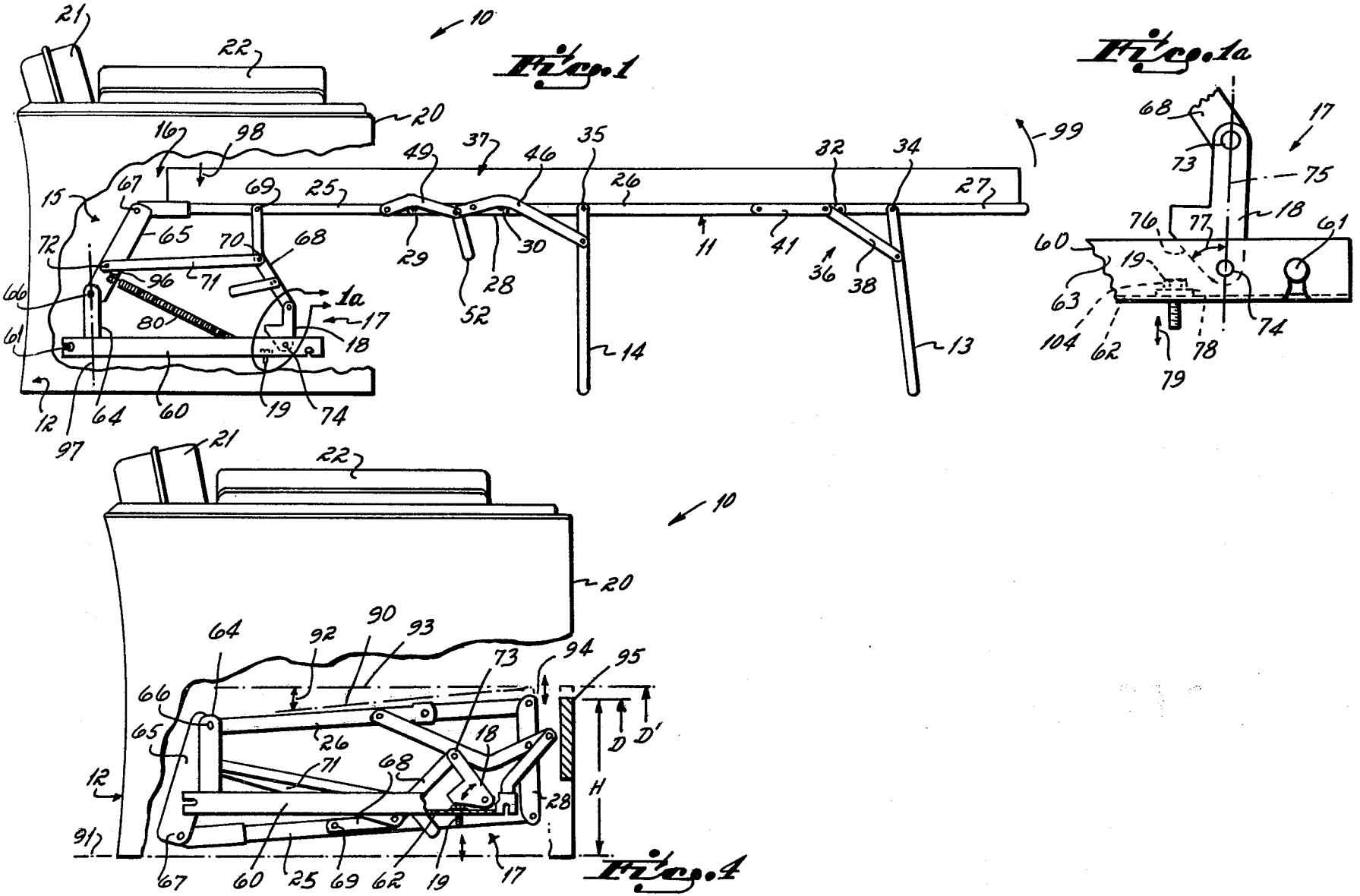
FIG. 4 is a side elevational view similar to FIGS. 1, 2 and 3, but showing the sofa sleeper's bed frame in the fully retracted or sofa position.

An improved sofa sleeper 10 in accord with the principles of this invention is shown in FIG. 1. The sofa sleeper 10 basically includes a foldable bed frame 11 and a sofa frame 12. The bed frame 11 includes front 13 and rear 14 legs to support the bed frame when it is in the bed position shown in FIG. 1. A collapsible frame support linkage 15 connects the bed frame's head end 16 with the sofa frame 12. The collapsible frame support linkage 15 functions to support the bed frame 11 in the bed position shown in FIG. 1 and to support the bed frame in the sofa position shown in FIG. 4. The seat adjustment mechanism 17 for the sofa sleeper 10, and to which this invention is particularly directed, includes styling link 18 and styling bolt 19, the structure and function of which are described in greater detail below.

The bed frame linkage system 11, 15 of the sofa sleeper 10 is illustrated as being mounted upon sofa frame 12 in the form of an upholstered sofa 20 which has backrest cushions 21 and sofa arms 22. The sofa frame 12 does not form any part of the invention of this application, and may comprise any well known standard upholstered sofa frame construction. The bed frame linkage system 11, 15 is directly connected to the sofa frame 12. It is to be understood that the structural members that comprise the foldable bed frame 11 and the collapsible frame support linkage 15 shown in the figures are duplicated on both sides of the sofa frame 12, i.e., a duplicate set of the elements illustrated and described are connected to each arm 22 frame of the sofa frame 12.

The foldable bed frame 11 of the sofa sleeper 10 includes pivotally interconnected head frame section 25, body frame section 26 and foot frame section 27. The head frame section 25 is pivotally connected as at 29 to head/body connector link 28, that head/body connector link being pivotally connected at the other end to body frame section 26 as at 30. The body frame section 26 is pivotally connected as at 31 to one end of the body/foot frame connector link 32, and the other end of that body/foot frame connector link is pivotally connected as at 33 to the foot frame section 27. In effect, and when the bed frame 11 is in the bed or extended position shown in FIG. 1, the head frame section 25, body frame section 26 and foot frame section 27 of the bed frame constitute one side rail of that bed frame.

Figure 2:
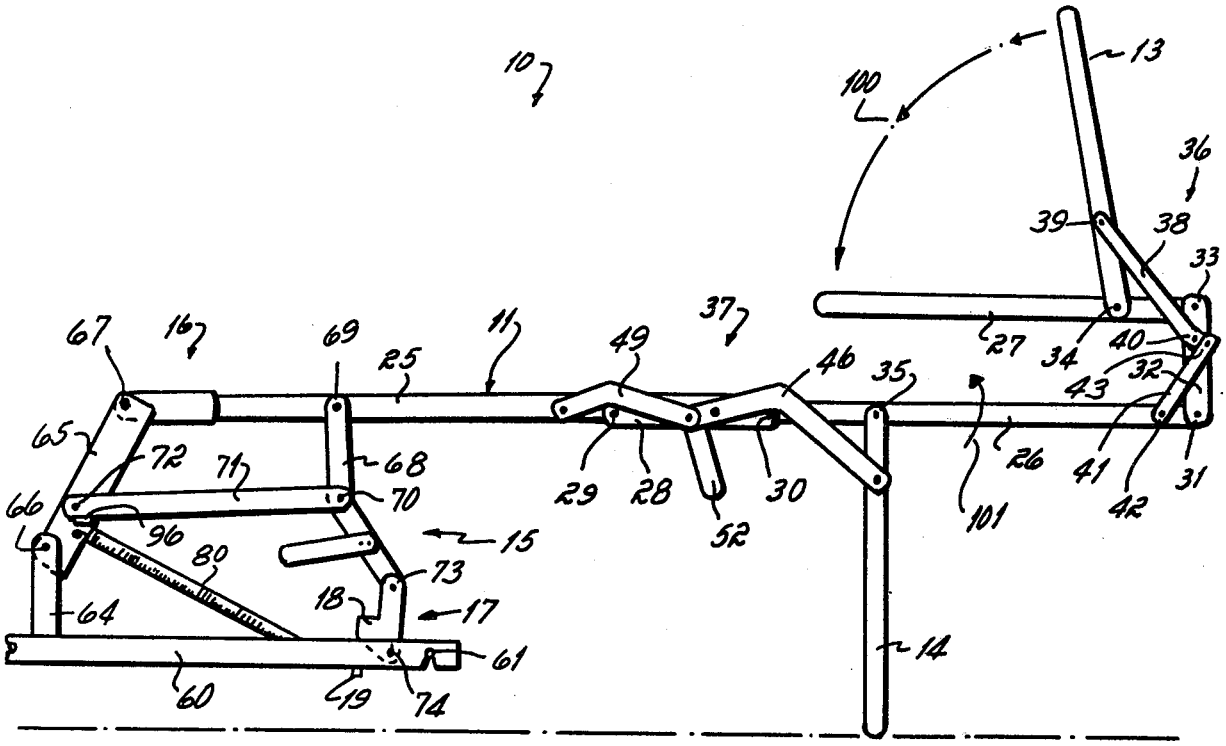
FIG. 2 is a side elevational view similar to FIG. 1, but showing the sofa sleeper's bed frame in a first intermediate position as it is retracted or folded up from the bed position shown in FIG. 1.
Figure 3:
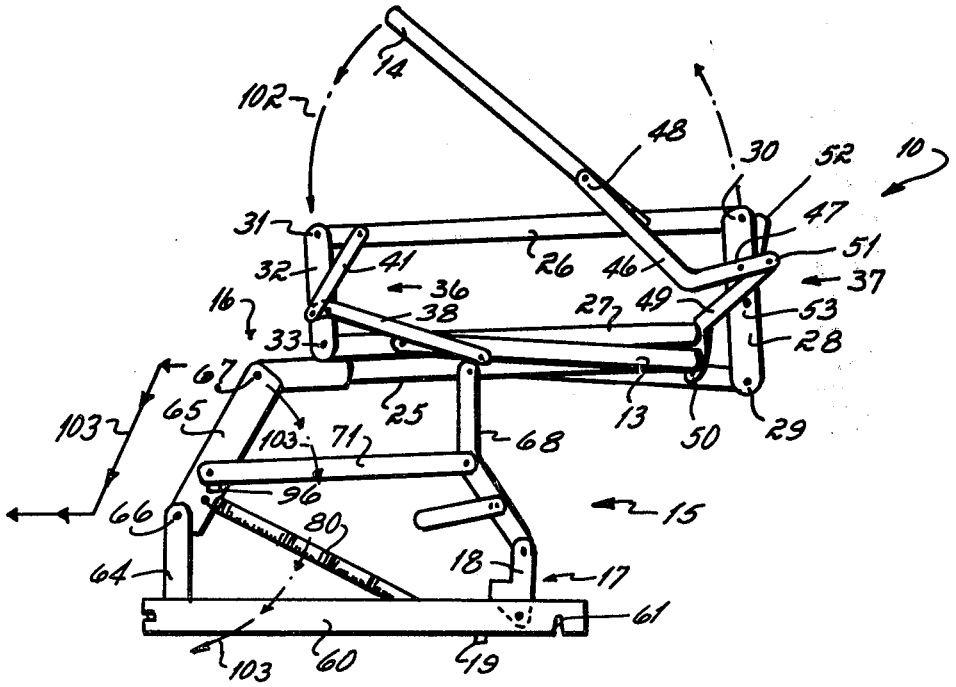
FIG. 3 is a side elevational view similar to FIG. 1 and 2, but showing the sofa sleeper's bed frame in a second intermediate position as it is retracted further from the FIG. 2 position.

The front leg 13 and the rear leg 14 for the bed frame 11 provide vertical support to the bed frame's foot 27 and body 26 sections when it is in the bed position. The front leg 13 is pivotally connected to the foot frame section 27 as at 34, and the rear leg 14 is pivotally connected to the body frame section 26 as at 35. A front lock linkage 36 cooperates with the front leg 13, and a rear lock linkage 37 cooperates with the rear leg 14, to maintain the front and rear legs in a locked position relative to the bed frame 25–27 when it is in the bed position. The front lock linkage 36 includes, as shown particularly in FIGS. 1 and 2, a dog-leg foot connect link 38 pivotally mounted at one end at 39 to the front leg 13 and pivotally mounted intermediate its ends as at 40 to the foot/body connector link 32. The foot lock linkage 36 also includes a body lock link 41 pivotally connected at one end as at 42 to the body frame section 26 and as at 43 to the other end of the foot connect link 38. THis front lock linkage 36 functions in an over center fashion, because of the relationship of pivot points 39, 40, 42, 43, relative on to the other, to lock the foot frame section 27 in linear configuration with the body frame section 26 when the bed frame is in the bed position as shown in FIG. 1, and to lock the foot frame section in parallel or overlaid position relative to the body frame section when the body frame is collapsed into the sofa configuration and the front leg 13 is pivoted into generally horizontal alignment with the foot frame section 27 as shown in FIG. 2. The rear lock linkage 37, which locks the rear leg 14 in bed position, is particularly shown in FIGS. 1 and 3. The rear lock linkage 37 includes dog-leg body connect link 46 pivotally connected as at 47 intermediate its ends to the body/head connector link 28, and pivotally connected at one end to the rear leg 14 as at 48. A head lock link 49 also of a dog-leg configuration is pivotally connected at one end to the head frame section 25 as at 50 and is pivotally connected at the other end to the other end of the body connect link 46 as at 51. The rear leg lock linkage 37 also functions in a over center fashion so that when the head frame section 25 and body frame section 26 are aligned in bed position as shown in FIG. 1, the rear leg 14 and sections 25, 26 are mechanically locked in bed configuration when the front leg 13 is positioned as shown, and so that when the body frame section overlies the head frame section as shown in FIG. 3, i.e., the sofa configuration, and when the rear leg 14 is pivoted into generally horizontal alignment with the body frame section 26, the body and head frame sections are locked into a collapsed position. A transverse support bar 52 is pivotally connected as at 53 to the bed frame's body/head connector links 28 on opposite sides of the bed frame to provide stability to the bed frame when erected and in bed position, that transverse support being swingable on pivot axis 53 into general parallel alignment with the body/head connector link 28 when in the sofa position as shown in FIG. 4.

The collapsible frame support linkage 15 connects the head frame section 25 of the bed frame 11, and therefore the bed frame itself, with the sofa frame 12. The collapsible frame support linkage 15 includes a base plate 60 fixed by bolts 61 to a side wall (not shown) of the sofa frame 12, thereby providing a stationary base plate to which the collapsible frame support linkage is connected. The base plate 60 is in the form of an angle member having horizontal flange 62 that extends inwardly from vertical flange 63. The collapsible frame support linkage 15 includes a vertical frame support post 64 immobily fixed to the base plate 60, and a linear head frame support rear link 65 pivotally connected as at 66 to the post at one end and pivotally connected as at 67 to the rear end of the head frame section 25 at the other end. A head frame support front link 68, which is of a dog-leg configuration, is pivotally connected at one end as at 69 to the head frame section 25 between the ends of that section, and is pivotally connected as at 70 at the dog-leg to one end of a collapsible control link 71. The control link 71 is pivotally connected as at 72 at its other end intermediate the ends of the rear link 65. The other end of the dog-leg front link 68 is pivotally connected as at 73 to one end of the styling link 18, and that styling link at its other end is pivotally connected as at 74 to the base plate 60. The styling link 18, as shown particularly in FIG. 1*a*, defines a phantom straight line 75 between its pivotal connections, and defines a support or stop edge 76 that is angled at an acute angle 77 relative to that straight line 75. The stop edge 76 of the styling link 18 cooperates with the styling bolt 19. The styling bolt 19 is threadedly connected with horizontal flange 62 of the base plate 60, the styling bolt being received in threaded collar 78 fixed to the flange 62. The styling bolt 19 is vertically adjustable (as shown by arrows 79) relative to the base plate 60 and, therefore, relative to ground, by virtue of the threaded relation between the bolt and the collar 78. An assist spring 80 connects the base plate 60 with the rear link 65, the tension spring providing assistance when the bed frame 11 is erected from the sofa position shown in FIG. 4 to the bed position shown in FIG. 1.

The seat adjustment mechanism, i.e., the styling link 18 and the styling bolt 19, cooperate to define only the retracted or storage position of the bed frame 11 and the collapsible frame support linkage 15. In other words, the styling link 18 and styling bolt 19 have no effect on the collapsible frame support linkage 15 or on the bed frame 11 itself, when the bed frame is in the bed position shown in FIG. 1. However, when the bed frame 11 and collapsible frame support linkage 15 are in the sofa position shown in FIG. 4, adjustment of the seat adjustment mechanism, i.e., adjustment of the styling bolt 19 relative to the styling link 18, functions to vary the pitch of the seat plane 90 defined by the folded up or collapsed bed frame 11 when the bed frame is in the sofa position. In other words, and by vertically raising the styling bolt 19 relative to ground 91, the pitch of the seat plane 90, i.e., the angle 92 of the seat plane relative to horizontal 93, is increased, and by vertically lowering the styling bolt relative to ground 91, the pitch of the seat plane is decreased. Further, and also as shown in FIG. 4, raising of the styling bolt 19 relative to ground 91 raises the height H of the retracted bed frame's front edge 94 relative to ground, and lowering of the styling bolt 19 reduces the height H of the bed frame's front edge relative to ground. This seat adjustment mechanism, therefore, allows a greater depth D' or lesser depth D front rail 95 to be used as part of the sofa frame 12. And this is desirable in that it permits different aesthetic styles or profiles for the front elevation of the sofa to be provided by the sofa sleeper manufacturer. Of course, the styling bolt 19 is adjusted vertically upward or downward simply by rotating the bolt since the bolt is threadedly engaged with collar 78 fixed to the stationary base plate 60 of the collapsible frame support linkage 15.

The sofa sleeper 10 is shown in the bed position in FIG. 1. In this FIG. 1 bed position, the bed frame 11, i.e., the head frame section 25, the body frame section 26, the foot frame section 27, the head/body count link 28 and the body/foot connect link 32, are kept in a rigid or locked position by virtue of front lock linkage 36 and rear lock linkage 37 as positioned by front 13 and rear 14 legs. Also in this bed position, the collapsible frame support linkage 15 is maintained in the bed attitude shown in FIG. 1 because control link 71 abuts stop 96 on the rear link 65. This is the case because pivot point 67 of the rear link 65 has moved forward of a vertical phantom line 97 that includes pivot 66 of that rear link with the fixed support post 64. Thus, a downward force 98 on the head frame section 25 prevents further collapse of the collapsible frame support linkage 15 when the bed frame 11 is in the bed position due to contact of the control link 71 with that stop 96.

When it is desired to translate the sofa sleeper 10 from the bed position shown in FIG. 1 to the sofa position shown in FIG. 4, the foot section 27 is initially drawn upwardly as shown by phantom arrow 99 and pivoted into overlying relation with the body frame section as shown in FIG. 2. This breaks the over-center front lock linkage 36. Subsequently, the front leg 13 is folded downwardly as shown by phantom arrow 100 into generally planar relation with the foot frame section 27, and when in substantial planar position it functions to lock up the front lock linkage 36 so that foot 27 and body 26 frame sections are held in generally parallel configuration. Thereafter, the body frame section 26 is lifted upwardly as shown by phantom arrow 101 causing same to pivot into overlying relation with the head frame section 25, compare FIG. 3 to FIG. 2. This breaks the over center rear lock linkage 37. In the generally overlying position shown in FIG. 3, the rear leg 14 is pivoted into generally planar relation with the body frame section 26 as shown by phantom arrow 102, thereby again locking up the rear lock linkage 37 so that the body frame section 26 is held in collapsed position with the head frame section 25 shown in FIG. 3. Subsequently, the collapsed foot 27, head 25, and body 26 frame sections are moved as shown by the direction arrow 103 which causes the rear link 65 to pivot on fixed point 66, thereby causing the entire folded up bed frame 11 to move downwardly until the styling link's stop edge 76 abuts the styling bolt's head 104. In other words, the final retracted or collapsed position of the bed frame 11 and collapsible frame support linkage 15 interiorly of the sofa frame 12 is established by the styling link 18 and styling bolt 19. As previously explained, the pitch 92 of the seat plane 90 relative to ground 91, and the height H of the front edge 94 of the collapsed bed frame in that stored position, are both established by abutment of the styling link 18 against the styling bolt 19. And also as previously explained, the pitch 92 of the seat plane 90, as well as the height H of the seat frame's front edge 94, relative to ground 91, can be varied in that retracted or sofa position depending on the vertical position of the styling bolt's head 104 relative to ground.

Of course, to translate the foldable bed frame 11 and the collapsible frame support linkage 15 from the collapsed sofa position shown in FIG. 4 to the erect bed position shown in FIG 1, the sequence of steps is simply reversed.

Having described in detail the preferred embodiment of my invention, what I desire to claim and protect by Letters Patent is:

1. A sofa sleeper comprising a sofa frame, a bed frame having at least a head frame section and a foot frame section, said sections being foldable relative one to the other between an extended bed position and a folded up sofa position, a base plate fixedly connected to said sofa frame, a collapsible frame support linkage, said support linkage being connected to said bed frame and to said sofa frame, said linkage functioning to extend said bed frame from sofa position, and to retract said bed frame into sofa position, with said sofa frame, said support linkage including a styling link and a styling bolt threadedly mounted on said base plate and engageable with said styling link, said styling bolt being adjustable between plural styling positions, the pitch of the seat plane defined by the folded up bed frame when in the sofa position being increased or decreased in response to adjustment of said styling bolt.

2. A sofa sleeper as set forth in claim 1, said base plate comprising an angle member having a horizontal flange, said styling bolt being threadedly mounted for vertical adjustment to said horizontal flange.

3. A sofa sleeper as set forth in claim 1, said collapsed frame support linkage comprising a rear support link pivoted at one end to said base plate and at the other end to said bed frame's head section, and a front support link pivoted at one end to said bed frame's head section and at the other end to one end of said styling link, the other end of said styling link being pivoted to said base plate.

4. A sofa sleeper as set forth in claim 3, said styling link defining a stop edge that is positioned at an acute angle relative to a phantom line that connects the pivot connections of said styling link with said front support link and with said base plate.

5. In a sofa sleeper having a sofa frame, a base plate adapted to be fixedly secured to said sofa frame, a bed frame having at least a head frame section and a foot frame section wherein said sections are foldable relative one to the other between an extended-out bed position and a folded-up sofa position, a collapsible frame support linkage connecting said bed frame and said base plate, said frame support linkage functioning to extend said bed frame from its sofa position and to retract said bed frame into its sofa position relative to said base plate, the improvement comprising said frame support linkage including a styling link and a styling bolt adjustably connected to said base plate, said styling bolt being adjustable between plural styling positions, said styling bolt cooperating with said styling link to locate the front edge elevation of said bed frame in retracted position within said sofa frame, the pitch of the seat plane defined by the folded-up bed frame when in the sofa position being increased or decreased in response to adjustment of said styling bolt.

6. An improvement as set forth in claim 5, said base plate comprising an angle member having a horizontal flange, said styling bolt being threadedly mounted for vertical adjustment to said horizontal flange.

7. An improvement as set forth in claim 5, said collapsible frame support linkage comprising a rear support link pivoted at one end to said base plate and at the other end to said bed frame's head section, and a front support link pivoted at one end to said bed frame's head section and at the other end to one end of said styling link, the other end of said styling link being pivoted to said base plate.

8. An improvement as set forth in claim 7, said styling link defining a stop edge that is positioned at an acute angle relative to a phantom line that connects the pivot connection of said styling link with said front support link and with said base plate.

* * * * *